US011992077B2

(12) United States Patent
Reece et al.

(10) Patent No.: US 11,992,077 B2
(45) Date of Patent: May 28, 2024

(54) TWO LAYER CHIN CUP

(71) Applicants: Vincent G Reece, Parker, CO (US); David Fowler, Boulder, CO (US)

(72) Inventors: Vincent G Reece, Parker, CO (US); David Fowler, Boulder, CO (US)

( * ) Notice: Subject to any disclaimer, the term of this patent is extended or adjusted under 35 U.S.C. 154(b) by 0 days.

(21) Appl. No.: 17/443,804

(22) Filed: Jul. 27, 2021

(65) Prior Publication Data

US 2023/0030261 A1 Feb. 2, 2023

(51) Int. Cl.
*A42B 3/08* (2006.01)
*A42B 3/20* (2006.01)
*A42B 3/28* (2006.01)

(52) U.S. Cl.
CPC ..... *A42B 3/205* (2013.01); *A42B 3/08* (2013.01); *A42B 3/283* (2013.01)

(58) Field of Classification Search
CPC ..... A42B 3/205; A42B 3/08
USPC ..... 2/421
See application file for complete search history.

(56) References Cited

U.S. PATENT DOCUMENTS 2,886,818 A 5/1959 Roberts
3,916,446 A 11/1975 Gooding
4,051,556 A 10/1977 Davenport et al.
4,062,068 A 12/1977 Davenport et al.
4,651,356 A 3/1987 Zide
5,077,870 A 1/1992 Melbye et al.
5,517,986 A * 5/1996 Starr ..... A61M 16/0633 128/205.25
5,607,635 A 3/1997 Melbye et al.
6,481,024 B1 * 11/2002 Grant ..... A42B 3/08 2/9
7,152,253 B2 12/2006 Abelman et al.
7,188,396 B2 3/2007 Melbye et al.
7,866,370 B2 2/2011 Winningham
8,621,671 B1 * 1/2014 Schiebl ..... A42B 3/205 2/421
8,959,668 B1 2/2015 Ganes et al.
2006/0117466 A1 6/2006 Abelman et al.
2009/0107514 A1 * 4/2009 Winningham ..... A42B 3/08 2/9
2009/0265841 A1 10/2009 Ferrara
2013/0111654 A1 * 5/2013 Gorsen ..... A42B 3/205 2/421
2017/0311669 A1 * 11/2017 Morin ..... A42B 3/205
2019/0117002 A1 4/2019 Dawson et al.

FOREIGN PATENT DOCUMENTS

GB 1354719 6/1974

* cited by examiner

*Primary Examiner* — Timothy K Trieu
(74) *Attorney, Agent, or Firm* — Law Office of Lewis Brande; Lewis M Brande

(57) ABSTRACT

A chin cup has a hard outer cup and a soft inner cup that may be removable from the outer cup. The inner cup has a peripheral edge extending beyond the edges of the outer cup. Strap guides that allow a strap to slide through. A one size fits all design includes a central indentation that extends upward toward a top central portion of the cups as well as a central narrowing longitudinally of the cups. Aligned vent holes between the cups let the user's chin breathe. The cups have an arcuate longitudinal arch shape. The chin cup includes a boss and hole design that has mushroom caps that prevents the separation of the cups when not in use, the soft inner cup imbedded in the hard outer cup.

9 Claims, 13 Drawing Sheets

TWO LAYER CHIN CUP

CROSS REFERENCE APPLICATION

This non-provisional application claims benefit of provisional application No. 62/691,529 filed Jun. 28, 2018 which is incorporated herein by reference in its entirety.

This application is a continuing-in-part application to U.S. application Ser. No. 16/449,566, filed Jun. 24, 2019 and claims benefit therefrom and is incorporated herein by reference in its entirety.

FIELD OF THE INVENTION

The present invention relates to providing a chin cup, for use with headgear used for protection in sporting activities, to prevent a chin strap from sliding into the user's throat, which could interfere with blood flow to the brain or air flow to the lungs.

BACKGROUND

In the sport of wrestling, it is common for the wrestler to wear headgear-having ear protection. A strap can go under the chin to secure the ear guards onto the head. This strap can cause choking during a match or Lack of blood flow to the brain. Such a product is exemplified by the Asics' Unrestrained Sublimated Ear guard.

Other designs provide ear guards and have a plastic strap go from ear guard to ear guard with a hard plastic chin cup. The chin cup can have external loops for the plastic strap. Such a product is exemplified by the Asics' Snap Down Earguard. This product has no breathing holes and places an uncomfortable hard plastic cup against the chin. This design is also vulnerable to having a slippery hard plastic cup slip off the user's chin into the throat or up across the mouth and/or nose.

Other related prior art includes the following references.

Pub. No. U.S. 2009/0265841 discloses a solid chin cup for a football helmet that has a soft inner liner 58 of very soft compliant rubber or plastic material. The liner 58 conforms to the shell 52 and has a raised resilient edge margin 58*a* which engages over the edge of shell 52 (para 0037) It has a separate Left and right helmet strap. There are no air vents.

Pub. No. U.S. 2006/0117466 and U.S. Pat. No. 7,152,253 disclose a boxing and martial arts chin cup that has an outer harder cup made of foam material and a softer inner cup made of a plastic such as polyvinyl nitrile lining. FIGS. 5, 6 and column3 line 29 define an indentation 21A for receiving the chin. A hook and loop fastening strap secures the chin cup. No vent holes are provided.

U.S. Pat. No. 8,959,668 discloses a padded chin cup with interior webbing with FIG. 5 showing a five-layer chin cup. Separate chin straps are used. No vent holes are provided.

U.S. Pat. No. 6,481,024 discloses a chin cup with a hard outer shell and an inner cushioned material. A very pronounced indentation, pocket 59, is seen in FIG. 6. Vent holes are provided in both the outer and inner cups. A left and right helmet strap is used.

U.S. Pat. No. 4,651,356 discloses a unitized molded elastomer football chin cup with integral straps. Divergent straps eliminate movement of a hard football helmet. A pad 19 forms an inner layer.

U.S. Pat. Nos. 4,062,068 and 4,051,556 disclose a four-strap chin cup.

U.S. Pat. No. 3,916,446 discloses a chin cup made of a double knit fabric cup and a liner.

U.S. Pat. No. 2,886,818 discloses wrestling headgear 15 with a dual strap chin band.

GB1,354,719 by Dennett describes " . . . opposing hook members 10 which are mounted on the outer side of the chin cup; the opposed hook members 10 straddle the saddle 3 and have their stems 11 spaced by the width of the chin strap, i.e., the width of the track." The use of hook members disclosed and described by Dennett is specific because Dennett specifically discloses that the chin strap is secured on the outside of the chin cup by the opposing hook members. This allows the chin strap the be positioned from the outside of the chin cup. In fact, this design poses an injury hazard to any user. The hook members can scratch the face of a user or a user's opponent due to the nature of the hook members. The present invention is distinguished from Dennett by having 3 guides (4, 5, and 6), where the guides (4, 5, and 6) rise above the outer cup (2) and essentially have slots defined therein that allow a chin strap to be guided and fully encapsulated and thereby prevent the chin strap from being dislodged from the chin cup, as opposed to Dennett, it is possible for the strap to become dislodged because the strap is not fully captured because they are only held in place on the outer portion of the chin cup by protruding members, or hooks.

The present invention does not define any channel for the strap to be guided. The guides (4, 5, and 6) fully encapsulate a portion of the strap to position the strap relative to the outer cup (2). In effect, the guides of the present invention are smooth and do not present an injury hazard to any user or user's opponent.

U.S. Pat. No. 8,621,671 by Schiebl describes Semi Circular Openings and Members or Tabs. Schiebl has two semi-circular openings 36 and 38 located centrally on the outer cup 16. The semi-circular openings 36 and 38 receive semi-circular shaped insert (or tabs) members 40 and 42 of the resilient layer. A bumper 44 is received between the semi-circular openings 36 and 38 and extends across. This bumper is designed 44 is designed to provide shock absorbency at the center of the shell. These insert members 40 and 42 of the inner resilient layer do not attach to the exterior cup or secure the inner resilient layer to the exterior shell nor do they protrude beyond the size of the hole, they just move in and out of the semi-circular holes 36 and 38 to provide shock absorbency.

The present invention has, buttons or mushroom caps that are not designed as a shock absorbency feature. The buttons or insert members are designed strictly to secure the soft insert onto the hard outer shell so it forms a one-piece system. The buttons or mushroom caps on the outer surface of the insert line up with corresponding holes on the outer shell and are pushed through and secured to the outer shell. The tabs are also larger than the hole it goes through on the outer shell so there is an overlap of material that holds the insert in position. Without this design to hold the insert onto the outer shell, the insert could slip out when the user does not have the chin cup secured to the user's chin via the straps, and is held in securely via the tabs. Additionally, the insert and outer shell were designed this way so the insert is detachable and removable for cleaning and replacement. The soft insert was also designed to be easily detachable so users could purchase different colors to mix and match with their school or team colors, or for fashion reasons. The exterior cups will also be offered in a variety of colors. This way users can customize the colors of their chin cup system.

U.S. Pat. No. 7,886,370 B2 by Winningham describes a chin cup design that uses a completely different method of securing the inner layer or chin pad to the exterior shell. In Winningham's design, the outer layer has a pair of slots 30 on opposite ends of the shell, and the inner layer also has slots that correspond to those on the inner layer. These slots receive an elongated member or strap that attaches the inner layer to the outer shell. The opposite ends of the straps are fed through the inner pad slots and the outer shell slots. Then the overlapping straps are coupled or fastened together with a hook or loop fastener on top of the exterior shell.

US 2019/0117002 A1 by Dawson et al. Published Apr. 25, 2019 describes a fastening system that incorporates a mushroom-type fastener. This invention specifically uses mushroom caps on opposing surfaces as described as a base and a mat. The fastening system actually uses downward pressure that forces the mushroom caps on the mat to engage the mushroom caps on the mat. In effect, this system is more akin to a hook-and-loop system similar to Velcro® as opposed to the current invention that inserts the mushroom caps that are located on the soft inner cup and are pressed through corresponding air holes in the hard outer cup where the expanding flanges of the mushroom cap provides fixity to the soft inner cup since the mushroom cap has expanded and imparts a normal force preventing the mushroom cap from being inadvertently dislocated from the hared outer cup.

Similarly, U.S. Pat. Nos. 5,077,870, 5,607,635, and 7,188,396 by Melby et al. all describe mushroom-type hook strips for a hook-and-loop fastener that uses opposing strips of mushroom-type hooks that interlock with each other preventing dislocation of the attached strips. As previously described, this system is more akin to a hook-and-loop system similar to Velcro® as opposed to the current invention that inserts the mushroom caps that are located on the soft inner cup and are pressed through corresponding air holes in the hard outer cup where the expanding flanges of the mushroom cap provides fixity to the soft inner cup since the mushroom cap has expanded and imparts a normal force preventing the mushroom cap from being inadvertently dislocated from the hared outer cup. The aforementioned patents are more dissimilar than similar to the present invention as they rely upon opposing sets of mushroom caps on strips similar to Velcro® strips to provide fastening.

The present invention's chin cup consists of two pieces—a hard exterior shell and a softer insert. The softer insert attaches to and is held securely together via members, tabs or mushroom caps that protrude from the outer side of the soft insert, and are lined up with corresponding holes in the exterior shell. The bosses with mushroom caps are received through these holes and pushed through. The buttons or mushroom caps on the exterior of the insert line up with four holes on the outer shell and are pushed through and secured to the outer shell. Since the buttons are larger than the vent hole after the buttons have expanded, they penetrate through on the outer shell so there is an overlap of material that holds the insert in. Without this design, as shown in Winningham, to hold the insert onto the outer shell, the insert could fall out when the user does not have the chin cup secured to the user's chin via the straps, and is held in securely via the tabs. This could also occur during competition. Additionally, in the present application, the insert and outer shell were designed this way so the insert is easily detachable and removable for cleaning, sanitizing, and replacement. As described previously, the soft insert was designed to be detachable so users could also purchase different colors to mix and match with their school or team colors, or for fashion reasons. The exterior cups will also be offered in a variety of colors. This way users can customize the colors of their chin cup system.

Amazon Cliff Keen® wrestling chin cup is a basic hard chin cup with dual straps going over the cup and a left and a right guide.

Alibaba.com A&amp, R Sports Hockey Player chin cup has guides to prevent the strap from falling off the cup.

Alibaba.com Adams® Hard Cup Baseball Chin cup with strap has a Neoprene liner and has guides to stop the strap from falling off.

Alibaba.com Cliff Keen® Wrestling Chin Cup-White assembly has a hard chin cup and a dual strap going over the top and bottom of the cup.

Alibaba.com Riddell® Hard Chin Cup Strap has left and right straps. It has a liner and vent holes.

Alibaba.com 5 Lock Doctor Lacrosse Chin cup has Criss-cross straps that keep the straps from falling off the cup.

What is needed in the art is a universal sports chin cup that has three outer strap guides to receive a variety of straps outside the hard outer cup. The soft inner cup must absorb impacts and protect the chin of the user. Vent holes must go through both the inner and outer cups. A central depression must help prevent the device from slipping off the chin. The present invention meets all these needs and more.

SUMMARY OF THE INVENTION

The main aspect of the present invention is to provide a sports chin cup that has a plurality of strap guides on the hard outer cup (also called a shell) to receive a variety of chin straps.

Another aspect of the present invention is to provide a guide for the straps using holes in positioning bosses located on the hard outer cup in order to stabilize the device.

Another aspect of the present invention is to provide a resilient inner cup (also called an insert).

Another aspect of the present invention is to provide vent holes through both the inner and the outer cups.

Another aspect of the present invention is to provide an overmold embodiment that produces a one-piece hard outer shell and inner (soft) insert chin cup.

Another aspect of the present invention is to provide an interlocking boss and hole separable union between the outer shell and the soft inner insert.

Other aspects of this invention will appear from the following description and appended claims, reference being made to the accompanying drawings forming a part of this specification wherein like reference characters designate corresponding parts in the several views.

Some of the non-obvious design features are listed below.

1. Two-piece system designed to provide structure and rugged durability with the outside, shell component.
2. Both components are specifically designed with contours to conform to the facial features of most humans.
3. Through holes in both pieces provide for the draining of perspiration away from the face and avoid pooling or build up.
4. The through holes, or slots are also designed to allow the facial skin to compress against the inside layer of the softer inner cup (insert) and protrude slightly through the insert to lock the insert in place against the facial skin and avoid slipping and sliding during competition.
5. Both the softer inner cup (insert) and the harder outer cup (shell) have a cut-out feature along the edge of the center of the Chin Cup. This is specifically designed to remove interference with the trachea, Adams Apple or throat. Even in extreme cases where the chin strap/cup might slip off the chin and into the throat area, the interference with the air and blood flow is minimized.

6. Insert ridge: There is a small lip or shoulder designed along the entire edge of the soft inner cup (insert) to allow for the hard outer cup (shell) to be positioned onto the outside of the soft inner cup (insert) securely. The small lip or shoulder centers and locates the insert in all directions.
7. Raised Feature/Strap slots: Three slightly raised features or bosses have holes creating slots that are designed into the hard outer cup (shell) of the invention to allow the straps to be fed through the slots. This will enable the strap to be securely assembled to the shell. These raised features having slots defined within them, are located in-line across the middle of the product to ensure that the Chin Cup stays in place even with pulling, pushing or twisting forces.
8. Hard Outer Cup (Shell) Material: The Hard Outer Cup (Shell) material will be an injection molded polymer such as Polypropylene, ABS a Polystyrene blend, or similar structurally stiff material. The hard outer cup (shell) is intended to be rigid enough to provide structure and support while still allowing some flexibility in its design to avoid injury to the wearer or damage to the product itself. Significant forces may be applied to this component while minimizing the risk of breaking or injury.
9. Soft Inner Cup (Insert) Material: The soft inner cup (insert) is intended to be a softer, lower durometer material that mimics rubber, to allow for some compression and a softer, more comfortable feeling while being worn against the skin of the face. This material is expected to be a TPE Compound based upon Styrene-Ethylene/Butylene-Styrene Block Polymer, or other type of rubber or similar material.

A property of the TPE compound is that it adheres to polypropolyne.
10. One embodiment is included to allow periodic removal of the soft insert yet keep it firmly secured at other times with the chin strap open. This will allow periodic removal for cleaning, change of durometer rating or color.
11. Mushroom caps or buttons are used to secure the soft inner cup to the hard outer cup by using corresponding holes where the mushroom caps expand to be larger than the holes securing the soft inner cup and hard outer cup together.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF DRAWINGS

Figure 1:
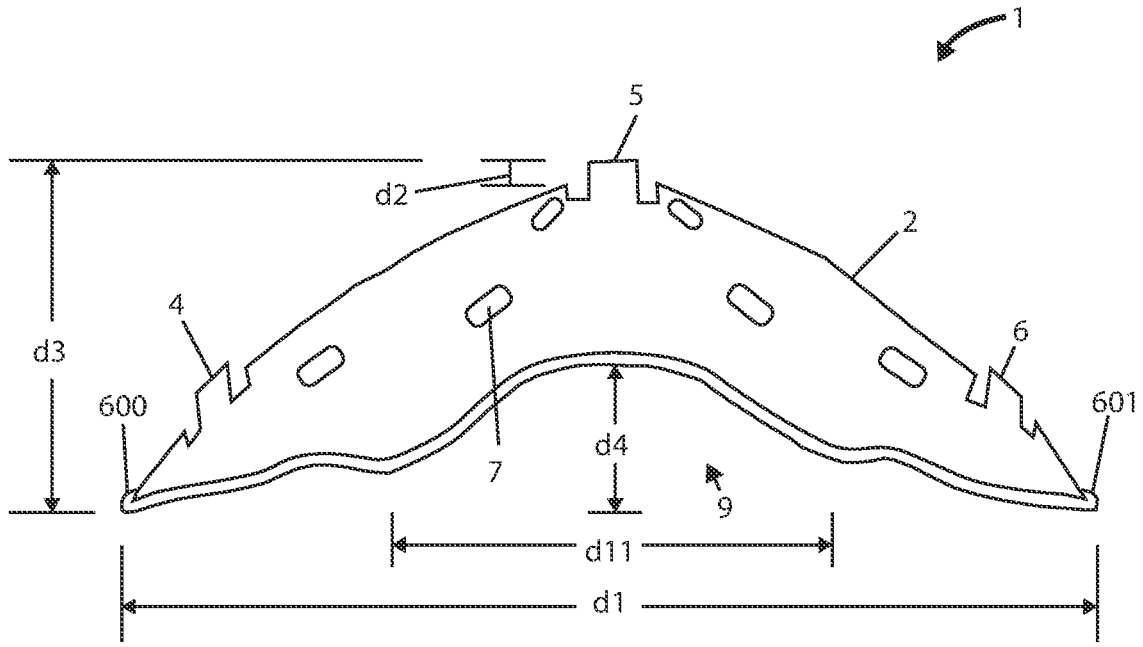
FIG. 1 is a front elevation view for my chin cup.
Figure 2:
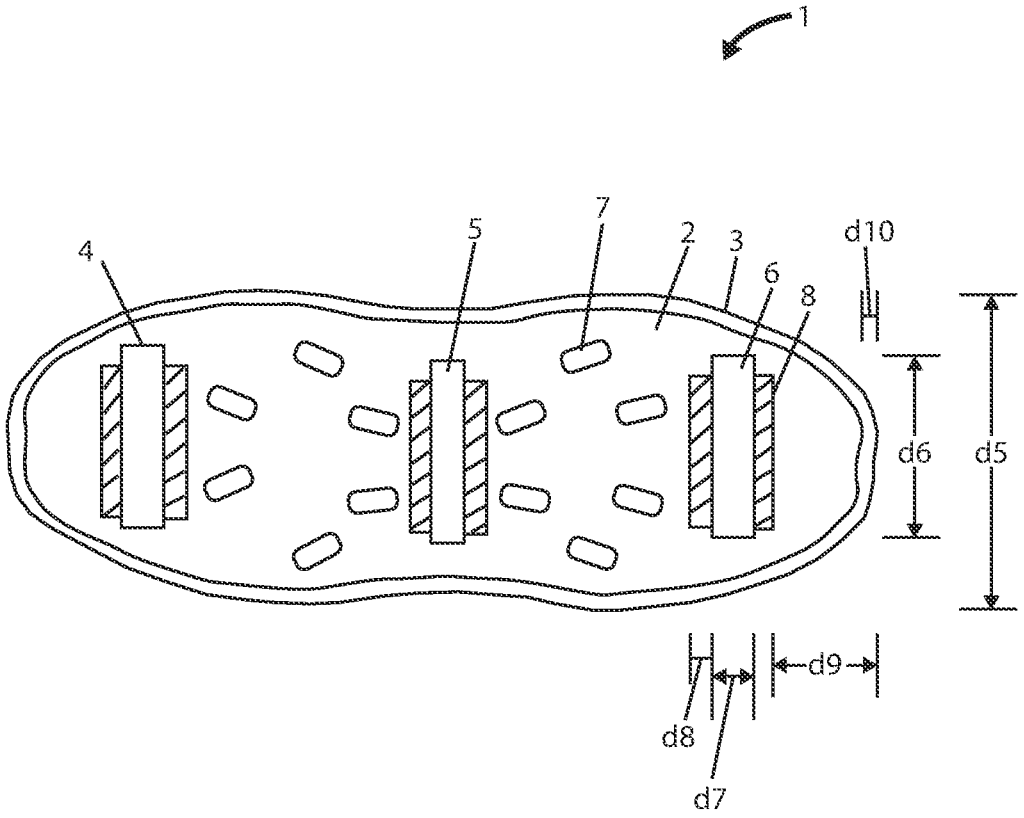
FIG. 2 is a top plan view thereof.
Figure 3:
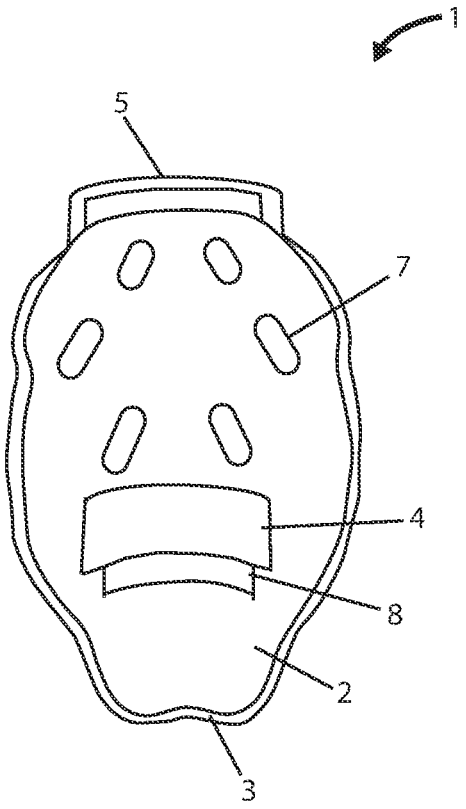
FIG. 3 is a left side elevation view thereof, a right-side elevation view being identical.

Referring first to FIGS. 1 and 2, the chin cup 1 consists of a hard outer cup 2 (or hard cup) and a soft inner cup 3 (or soft cup). Vent holes 7 are preferably slots (about six on each side) that pass through both cups 2, 3 to vent the athlete's heat and perspiration. Nominal dimensions are d1=3⅞ to 4⅛ inch, d2=1/d ¼ inch, d 3=1⅛ to 1½ inch, d4⅝ inch, d5 1⅝ inch, d6 1 inch, d 7=⅜ inch, d8—⅛ inch, d9—⅝ inch, d 10 1/16 inch, d 11=1¼ inch.

All three guides 4, 5, and 6, rise up between ⅛-¼ inch (d2) above the outside surface of the hard cup 2. Each guide 4, 5, and 6 is 1 inch in length (d6) and ⅜ inch in width (d7). Each guide 4, 5, and 6, has a space 8 on each side of each guide is ⅛ inch in width (d8). Each side guide 4, 6 starts with its space 8 about ⅝ inch in from the end of the hard cup 2 (d9). The soft cup 3 extends out from the hard cup 2 about 1/16 inch (d10).

The design is a "one size fits all". The chin indentation 9 is 1¼ inch in length (d1 l) and about ⅝ inch high (d4). The length of the hard cup 2 is between 3⅞ and 4⅛ inches (d1), and the height is between 1⅛ and 1½ inches (d3).

The hard cup 2 can be made of acrylonitrile butadiene styrene (ABS) plastic, and/or polycarbonate, and/or polystyrene, and/or polyethylene, and/or polyurethane foam, and/or polypropylene. The soft inner cup 3 could be selected from the group consisting of silastic gel, foam plastic, foam rubber, rubber (Thermoplastic Elastomer, or a TPE Compound based upon Styrene-Ethylene/Butylene-Styrene Block Polymer), silicone or polyurethane (Thermoplastic Polyurethane or TPU) and for the purposes of the current invention, should all be considered rubber-like in properties. Optional properties of the inner cup 3 include:

Removable: removable, washable.

Anti-microbial: to eliminate odor causing bacteria.

Eliminates 99.9% of odor causing bacteria in less than one hour of exposure.

All natural: safe and non-toxic, containing no chemicals.

Figure 4:
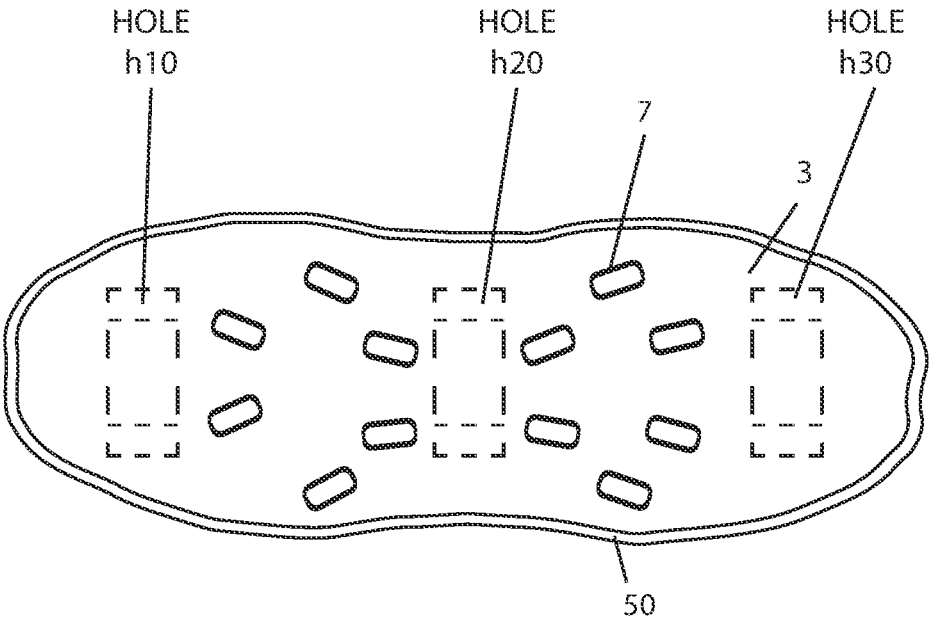
FIG. 4 is a bottom plan view thereof.

Referring next to FIG. 4 the inner cup 3 does not have to have the spaces 8 of the hard cup 2 since, preferably, any strap would only pass through the guides 4, 5, 6 of the hard outer cup 2. The hard outer cup 3 has holes h10, h20, and h30, (shown as broken lines) that correspond to the spaces 8 for each guide 4, 5, and 6 that penetrate the outer surface of the hard outer cup 2, but not through the strap guides 4, 5, and 6.

Figure 5:
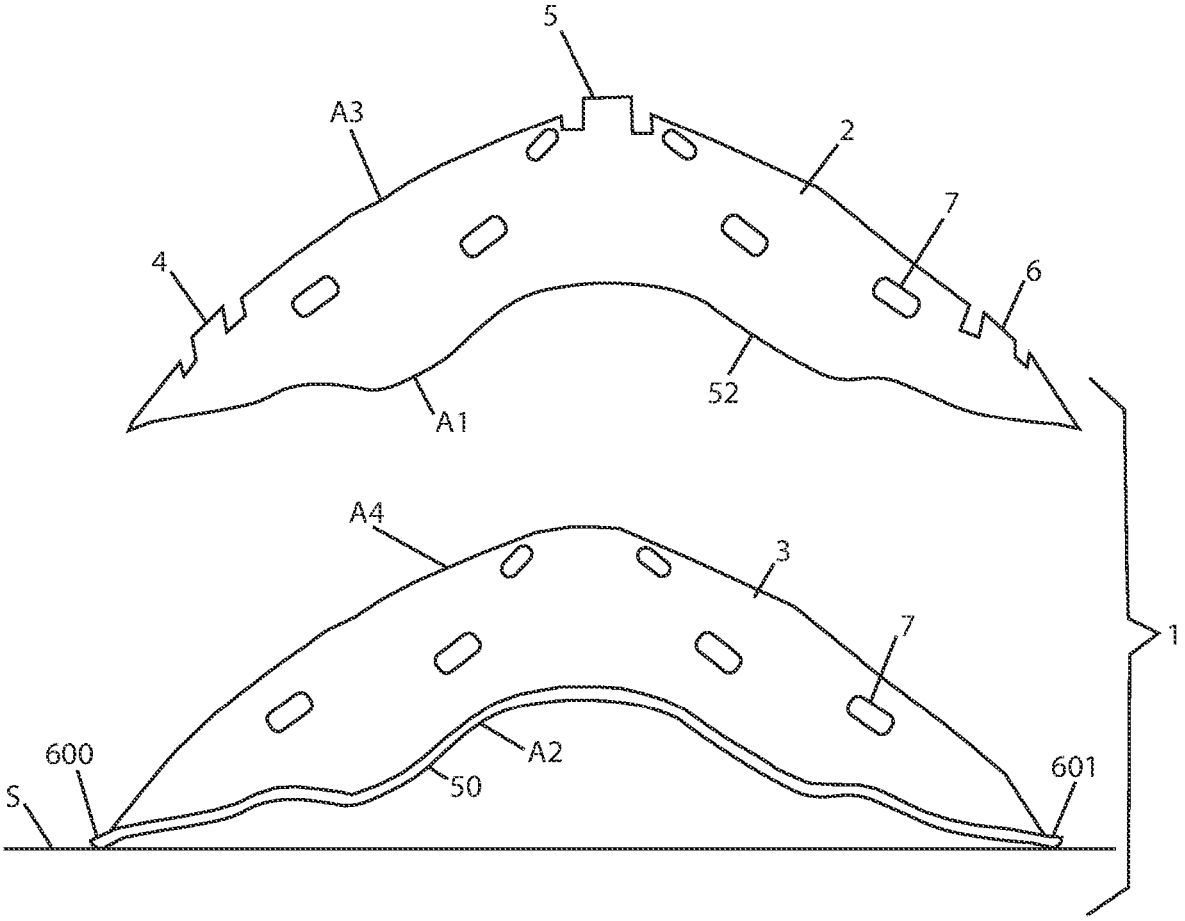
FIG. 5 is a front elevation exploded view thereof.

In FIG. 5 the soft inner cup's peripheral ridge 50 does protrude outside the edges of the outer cup 2. The vent holes 7, of which there are six on each side, are aligned between the inner and outer cups 3, 2.

Figure 6:
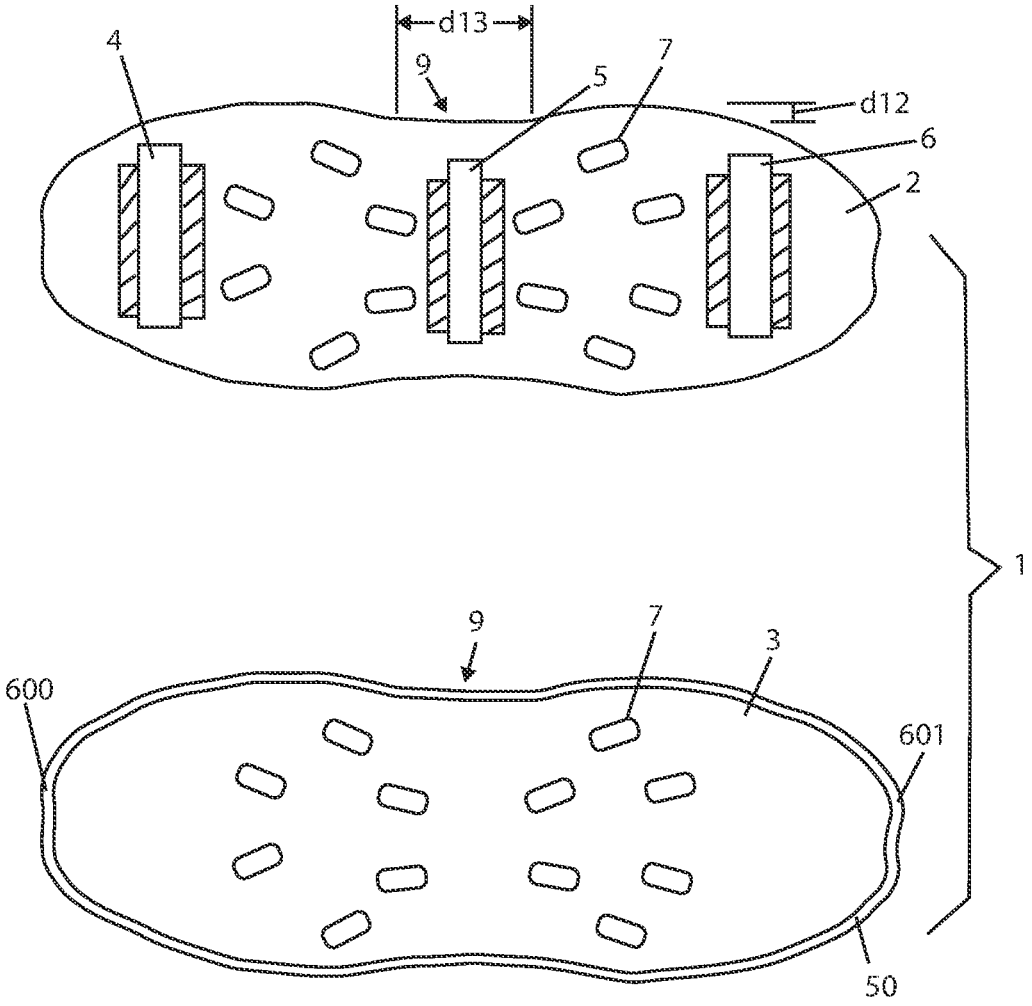
FIG. 6 is a top plan exploded view thereof.

In FIG. 6 it can be seen that the indentation 9 on the outer perimeter of the cups includes a central portion that has a centrally located narrowing portion that is positioned lengthwise with approximate dimensions of d 12=1/16-3/16 inch and d 13=1-1¼ inch. The chin cup 1 when placed on a flat surface, as in in FIG. 5, only rests on the surface at the tips 600, 601 of the soft inner cup 3. Thus, the overall inside perimeters of the hard outer cup 2 and soft inner cup 3 are designated A1 and A2 respectively in FIG. 5, and are arcuate in shape. The hard outer cup 2 has a peripheral edge 52 on the outer portion of the inside surface A1 of the outer cup 2. Preferably the outside surfaces of the hard outer cup 2 and soft inner cup 3, are designated A3 and A4, and are also arcuate in shape.

Figure 7:
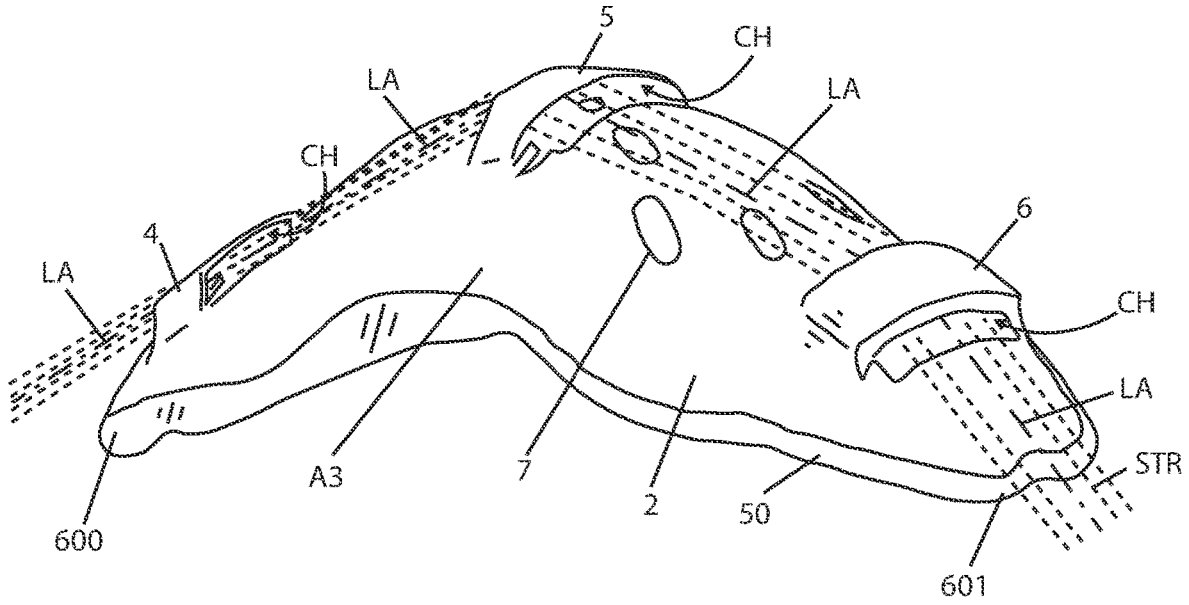
FIG. 7 is a front perspective view thereof.

Referring next to FIG. 7 the chin strap STR can be of any design including a dual strap, a cloth strap, a plastic strap, and/or a hook and loop. The strap STR passes through guides 4, 5, 6 on the outer surface A3 of the outer cup 2. The strap STR passes parallel to, or centrally along the longitudinal axis LA of the hard outer cup 2. The end 600 is designated the Left end, and the end 601 is designated the right end. The guides 4, 5, and 6 run laterally to the longitudinal axis LA. The guides have slots defined therein that are designated CH, that allow the strap STR to be guided through from one end of the cup 1 (end 600) to the opposing end of the cup 1 (end 601).

Figure 8:
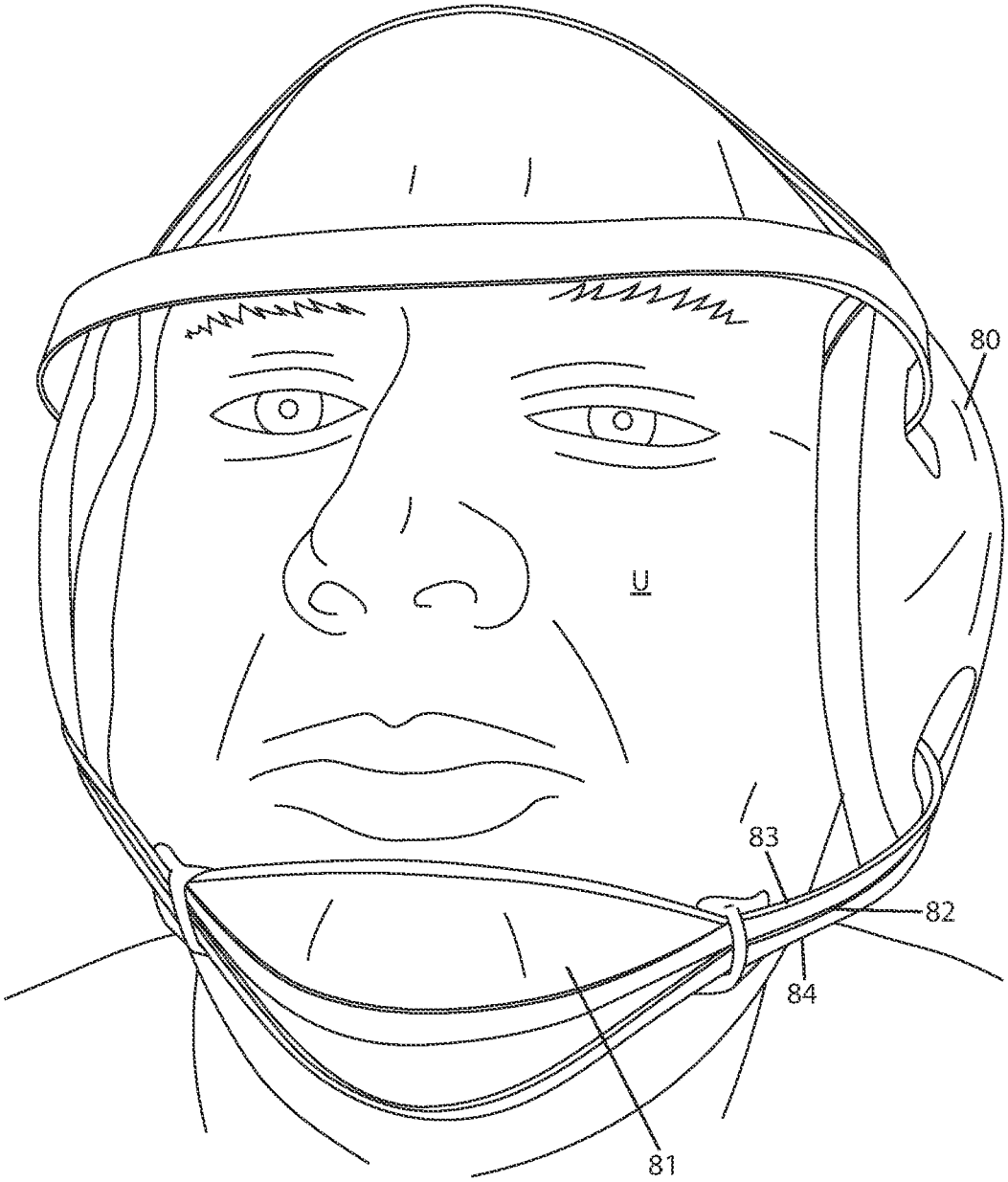
Fig. 8 (PRIOR ART)
FIG. 8 (prior art) is a front perspective view of a wrestling headgear with a chin cup.

Referring next to FIG. 8 a prior art wrestling head gear 80 is worn by the user U. A plastic chin strap 82 consists of side-by-side parallel strips, 83 and 84. These strips 83, 84 secure a hard plastic cup 81 to the user's chin. This cup 81 gets sweaty and tends to slip off the chin. The cup 81 has no Inner liner and no vent holes.

Figure 9:
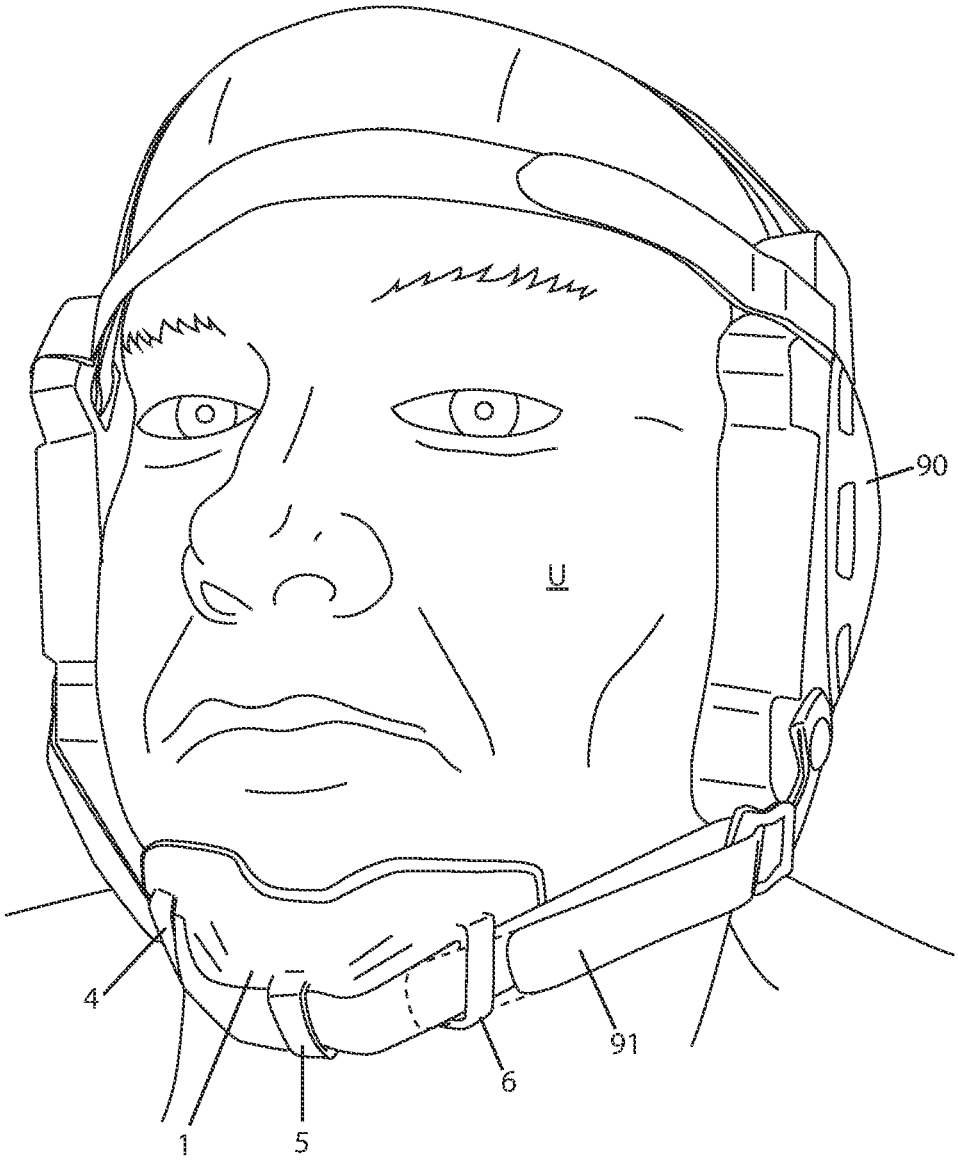
FIG. 9 is a front perspective view of a wrestling head gear having a chin strap and then fitted with the present invention.
Figure 10:
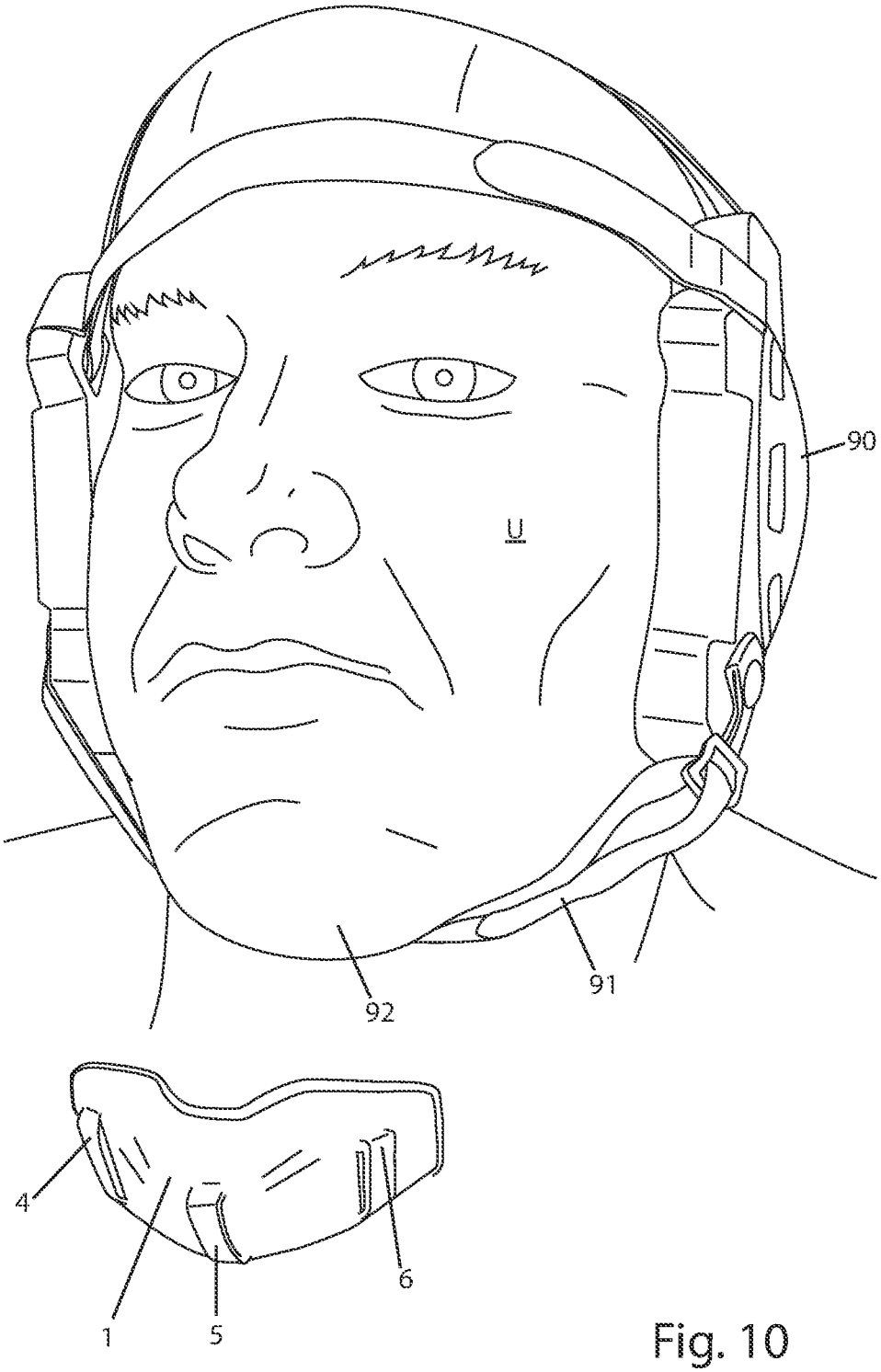
FIG. 10 is a front perspective view of a prior art wrestling head gear about to be upgraded with the present invention.

Referring next to FIG. 9 the user U has modified his head gear 90 from the traditional usage shown in FIG. 10.

The traditional usage has the chin strap 91 going under the chin 92 against the user's throat. This chin strap 91 can cause choking in a wrestling match.

The user U has taken the present invention chin cup 1, shown in FIG. 10, and threaded the (hook and loop) chin strap 91 through guides 4, 5, 6. The user U now uses the chin strap 91 to secure the chin cup 1 against his chin 92 as shown in FIG. 9.

An alternate embodiment uses an adhesive drop at one end of the insert to enable washing yet prevent losing the insert. An equivalent design includes a living hinge or a weld or any fastening means at one end of the insert.

Figure 11:
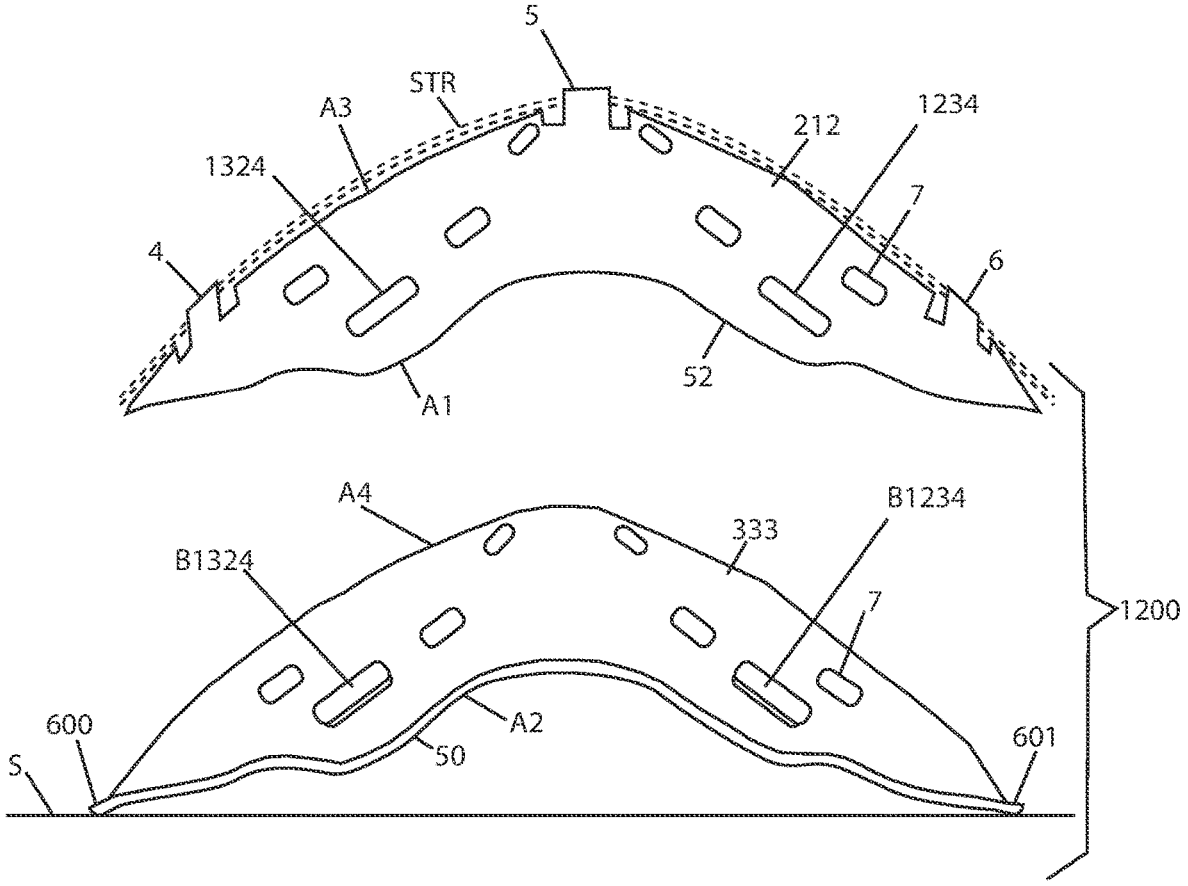
FIG. 11 is an exploded view of a boss and hole embodiment.

Referring next to FIG. 11 the chin cup 1200 is the same two-part design as chin cup 1 shown in FIGS. 1 and 5. An additional novel feature has been added. When a wrestler opens the strap and lets the chin strap dangle loosely from the headgear, the soft inner cup 3 can separate from the hard outer cup 2. To prevent this from happening, the chin cup 1200 has at least 4 bosses projecting upward from the top surface of the soft inner cup 333. Two bosses are labeled B1324 and B1234. These bosses are friction fitted into the respective holes 1324, 1234 in the hard outer cup 212.

Figure 13:
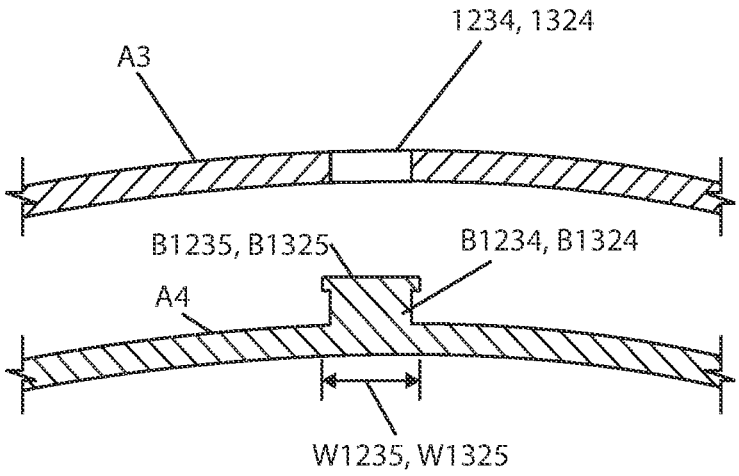
FIG. 13 is an exploded view showing the outer surface of the chin cup and inner cup and the relationship between B1234 and 1234.
Figure 14:
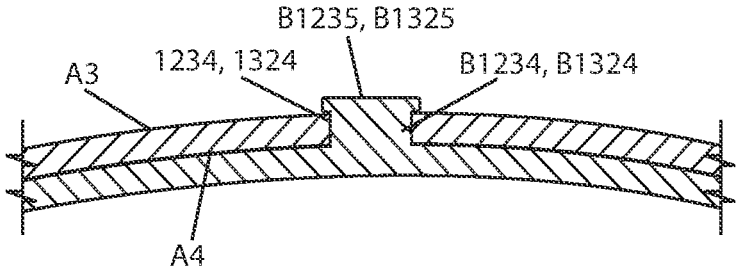
FIG. 14 is a view showing the outer surface of the chin cup and inner cup and the relationship between B1234 and 1234.

FIGS. 13 and 14 further describe the novel feature of the bosses. The bosses B1234 and B1324 have extensions, buttons, or "mushroom caps", B1235 and B1325 which are wider than bosses B1234 and B1324 and have a width of W1235 and W1325. The widths W1235 and W1325 are 1/16 to ⅛ inch wider than bosses B1324 and B1234 and extend equally around the bosses B1234 and B1324. The bosses B1234 and B1324 and the buttons B1235 and B1325 are made from the same material as the soft inner cup 333 and are therefore elastic as they are rubber-like. When the bosses B1234 and B1324 are fitted through holes 1234 and 1324, the buttons B1235 and B1325 extend out to their engineered width and become wider than holes 1234 and 1324 thereby locking the soft inner cup 3 to the hard outer cup 212 and preventing the soft inner cup 333 from being accidently dislodged from the hard outer cup 212. Although only holes 1234, 1324, bosses B1234, B1324 and buttons B1235 and B1325 are shown, the same components are presented on the opposing side of FIG. 11. Other design equivalents include using existing vent holes 7 in the hard outer cup 212 to receive bosses located where the matching vent holes 7 in the soft inner cup 3 existed.

Figure 12:
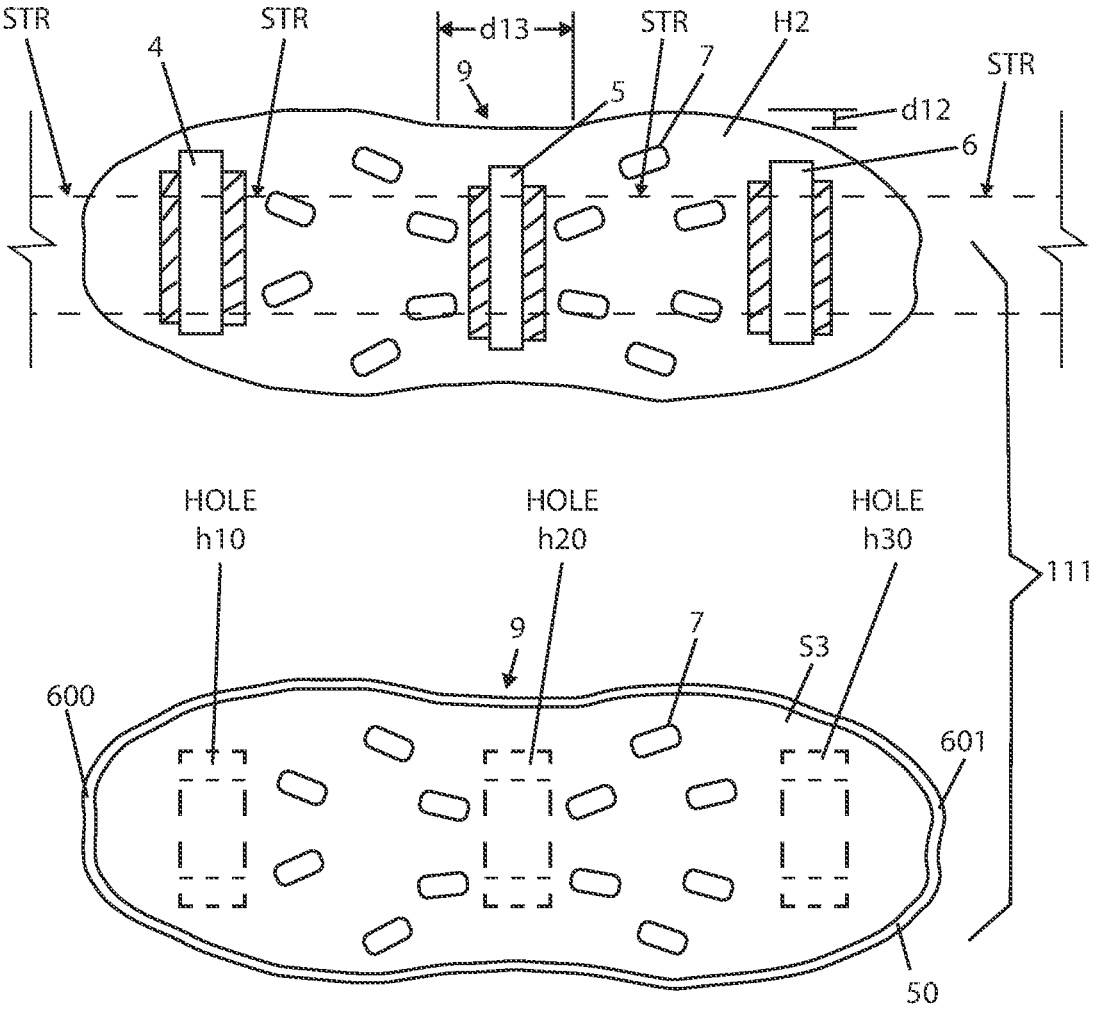
FIG. 12 is an exploded view of a one-piece chin strap embodiment made with an overmold.

Referring next to FIG. 12 chin cup 111 is a one-piece overmold design that produces the hard outer cup H2 first. Then in a second casting the soft inner cup, or liner S3, is made to melt into the hard outer cup H2 to form a one-piece chin strap 111. The cutouts H10, H20, and H30 facilitate the strap to be threaded under the guides 4, 5, 6. The strap in use does not touch the user. The soft inner cup S 3 is the only material in contact with the user.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A sports chin cup comprising:

a hard outer cup having an arcuate shape with a left end and a right end, a central portion, a longitudinal axis and vent holes;

a first boss, said first boss projecting upward from a top surface of the hard outer cup at a chosen distance from the left end and the right end, and a second boss, said second boss projecting upwards at the central portion, each boss projecting upwards having a hole defined therein defining a strap guide thereby;

said hard outer cup having an inside peripheral edge and having a central indentation along said inside peripheral edge of said hard outer cup;

said central indentation having a height relative to a height of the hard outer cup ranging from 42% to 55%; the height of the center of the hard outer cup ranging from 1 ⅛ to 1 ½ inch; said strap guides being aligned along the longitudinal axis;

a soft inner cup is shaped to fit smoothly within the hard outer cup; and said soft inner cup having vent holes defined therein, the vent holes being aligned with the vent holes in the hard outer cup, the soft inner cup having a peripheral ridge; wherein the peripheral ridge of the soft inner cup extending beyond a peripheral edge of the hard outer cup.

2. The chin cup of claim 1, wherein the hard outer cup further comprises a height at the central strap guide to a lowermost imaginary line drawn between the left and right ends wherein the height at the central strap guide ranges from 1 ⅛ inch to 1 ½ inch.

3. The chin cup of claim 2, wherein the hard outer cup has a length along its longitudinal axis ranging from 3 ⅞ inch to 4 ⅛ inch.

4. The chin cup of claim 1, wherein the soft inner cup further comprises a plurality of bosses projecting upward from an outside surface of said soft inner cup, each of said bosses projecting upward from said outside surface of said soft inner cup further having a mushroom caps defined thereon, the plurality of bosses and mushroom caps being integrally formed and of the same material as the soft inner cup, said mushroom cap being wider than a matching hole in the hard outer cup, said bosses and mushroom caps being received by the matching holes in the hard outer cup, the mushroom cups elastically expanding outwards from the hole in the outer cup firmly securing the soft inner cut to the hard outer cup, wherein said bosses positionally secure the soft inner cup against the inside the hard outer cup.

5. A sports chin cup comprising:

a hard outer cup having an arcuate shape with a left and a right end, a central portion, a longitudinal axis and vent holes;

a first boss, said first boss projecting upward from a top surface of the hard outer cup at a chosen distance from the left end and the right end, and a second boss, said second boss projecting upwards at the central portion, each boss projecting upwards having a hole defined therein defining a strap guide thereby;

said hard outer cup having a central indentation, said central indentation having a height relative to a height of the hard outer cup ranging from 42% to 55%;

the height of the center of the hard outer cup ranging from 1 ⅛ to 1 ½ inch; said strap guides being aligned along the longitudinal axis;

a soft inner cup having vent holes, the vent holes of the soft inner cup being aligned with the hard outer cup vent holes;

said soft inner cup having a peripheral ridge extending beyond a peripheral edge of the hard outer cup; said soft inner cup further comprises soft inner cup further comprises a plurality of bosses projecting upward from an outside surface, each of said plurality of bosses further having a mushroom cap defined thereon, the plurality of bosses and mushroom caps being integrally formed and of the same material as the soft inner cup and extend upwards from an outer surface of, said mushroom cap being wider than a matching hole in the hard outer cup, said bosses projecting upward from said outside surface and mushroom caps being received by the matching holes in the hard outer cup, the buttons elastically expanding outwards from the hole in the outer cup when pressed through the matching vent holes, firmly securing the soft inner cut to the hard outer cup, wherein said bosses positionally secure the soft inner cup against the inside the hard outer cup.

6. The chin cup of claim 5, wherein the hard outer cup further comprises a height at the central strap guide to a lowermost imaginary line drawn between the left and right ends ranges from 1 ⅛ inch to 1 ½ inch.

7. The chin cup of claim 5, wherein the hard outer cup has a length along its longitudinal axis ranging from 3 ⅞ inch to 4 ⅛ inch.

8. A sports chin cup comprising:

a hard outer cup having an arcuate shape to fit over a chin of a user;

said hard outer cup having a longitudinal axis, a left end and a right end and a peripheral edge;

said peripheral edge having a central indentation ranging from 42% to about 55% of a height of a center of the hard outer cup;

the height of the center of the hard outer cup ranging from 1 ⅛ to 1 ½ inch;

a plurality bosses projecting upward from a top surface of the hard outer cup along the longitudinal axis, each of said plurality of bosses having a hole defined therein, the holes defining chin strap guides;

a soft inner cup, the soft inner cup having vent holes, the vent holes of the soft inner cup being aligned with the hard outer cup vent holes of the hard outer cup;

said soft inner cup having a peripheral ridge extending beyond a peripheral edge of the hard outer cup;

the soft inner cup further comprises a plurality of bosses projecting upward from an outside surface, each of said plurality of bosses projecting upwards on the soft inner cup, further having a mushroom cap defined thereon, the plurality of bosses and mushroom caps being integrally formed and of the same material as the soft inner cup, said mushroom cap being wider than a matching hole in the hard outer cup, said plurality of bosses projecting upwards on said soft inner cup, and the mushroom caps on said plurality of bosses projecting upwards on said soft inner cup being received by the matching holes in the hard outer cup, the mushroom caps elastically expanding outwards from the holes in the outer cup after being pressed through the matching holes, firmly securing the soft inner cup to the hard outer cup, wherein said plurality of bosses positionally secure the soft inner cup against the inside the hard outer cup; and a plurality of vent holes defined within the hard outer cup and penetrating through the hard outer cup and aligning with a plurality of vent holes formed in the soft inner cup.

9. The chin cup of claim 8, wherein the hard outer cup has a length ranging from 3 ⅞ to 4 ⅛ inch.

* * * * *